United States Patent [19]

Kloppenburg et al.

[11] Patent Number: 4,473,229

[45] Date of Patent: Sep. 25, 1984

[54] GOLF BALL UTILIZING GRAPHITE MATERIALS

[76] Inventors: Jerry K. Kloppenburg, 9069 Tennyson, Bayside, Wis. 53217; Samuel E. Kinsley, 3067 North Lake Dr., Milwaukee, Wis. 53211

[21] Appl. No.: 364,878

[22] Filed: Apr. 2, 1982

[51] Int. Cl.[3] ..... A63B 37/06

[52] U.S. Cl. ..... 273/225; 273/230

[58] Field of Search ..... 273/218, 230, 222, 223, 273/224, 225, 226, 227, 228, 229, 214, 215, 216, DIG. 23, DIG. 7

[56] References Cited

U.S. PATENT DOCUMENTS

| | | | |
|---|---|---|---|
| Re. 25,427 | 7/1963 | Harkins | 273/230 |
| 2,225,213 | 12/1943 | Gammeter | 273/230 |
| 2,342,603 | 2/1944 | Ryan | 273/230 |
| 2,376,084 | 5/1945 | Radford | 273/230 |
| 2,542,356 | 2/1951 | Radford | 273/230 |
| 3,218,075 | 11/1965 | Shakespeare | 273/230 |
| 3,756,607 | 9/1973 | Lukinac | 273/218 |
| 3,787,051 | 1/1974 | Johns | 273/DIG. 23 |
| 3,804,421 | 4/1974 | Alex et al. | 273/DIG. 10 |

FOREIGN PATENT DOCUMENTS

| | | | |
|---|---|---|---|
| 52-32290 | 8/1977 | Japan | 273/218 |

*Primary Examiner*—George J. Marlo

*Attorney, Agent, or Firm*—Andrus, Sceales, Starke & Sawall

[57] ABSTRACT

A three-piece golf ball has a core formed of graphite materials uniformly dispersed throughout polymerized resin. The core may be wound with elastic thread or graphite yarn impregnated with resin. A two-piece golf ball utilizes a molded core of graphite in a resilient polymerized resin.

7 Claims, 2 Drawing Figures

GOLF BALL UTILIZING GRAPHITE MATERIALS

This invention relates to golf balls and more particularly to a three-piece golf ball with improved core and winding elements and a two-piece golf ball with an improved core element. The three-piece and two-piece golf balls of the present invention possess consistently high compression and resiliency so as to maintain perfectly round shape under continual use; high rebound characteristics; high initial velocity; excellent flight characteristics; and the ability to maintain strict manufacturing standards through normal production runs.

Heretofore, three-piece golf balls have been constructed with a spherical core of vulcanized rubber filled with suitable liquid, upon which is wound vulcanized elastic rubber thread under high tension. A suitable cover is then molded over the entire sphere so as to produce what is known as a three-piece golf ball meeting U.S.G.A. standards of: not greater than 1.620 oz. avoirdupois, and not less than 1.680 inches in diameter; such ball may not exhibit an initial velocity greater than 250 ft/second when measured on standard U.S.G.A. apparatus.

The shortcomings in manufacturing and use of three-piece golf balls are many. These difficulties include centering the core so as to have a perfect center of gravity without which roll and flight characteristics are erratic, rendering the golf ball essentially useless. The core tends to de-stabilize because the liquid leaks out of the core as for example through the needle puncture hole used to inject fluid. Loss of the fluid from the core reduces compression, elasticity, initial velocity and tends to accelerate out-of-roundness, a basic problem of three-piece golf balls affected by impact. Maintaining desired tension in the elastic windings across the cross section of the golf ball during mass production is difficult. Also, the windings may break. A rest period may be needed to equilibrate tension of the elastic threads across the cross section of the windings of the ball, slowing production and minimizing production efficiencies. The wound rubber loses roundness with repeated impact of the club head causing the ball to be out of round which results in the ball losing its flight and roll characteristics. And, age deteriorates the windings.

Despite the difficulties in manufacture, relatively higher costs and lower use life, the three-piece golf ball is the preferred construction of most golf professionals and skilled amateur players, who believe the three-piece golf ball has superior characteristics of compression, resiliency, rebound, club head feel, initial velocity, and flight and roll characteristics.

Several patents address these construction problems. These include U.S. Pat. No. 2,342,603 to G. K. Ryan directed to an improved sealing system for the core; U.S. Pat. No. 3,218,075 to H. G. Shakespeare, which substitutes fiberglass fibers and resins for the liquid filled rubber core; U.S. Pat. No. Re 25,427 to Harkins which substitutes a steel ball for the liquid filled rubber core; U.S. Pat. Nos. 2,376,084 and 2,542,356 to G. S. Radford, which disclose use of various ground materials or "pulverants" as substitutes for liquid in the vulcanized rubber sphere so as to avoid leaking and age deterioration. U.S. Pat. No. 2,225,213 to Gammeter discloses a method of improving the tension of the rubber windings so as to provide improved vulcanization or bonding with the cover and so as to maximize ball velocity due to improved elasticity and resiliency.

The two-piece golf ball entirely eliminates the liquid filled vulcanized rubber sphere-core and the difficult-to-control-and-apply elastic windings; and substitutes a solid core approximately 1.60 inches in diameter to which is vulcanized or bonded a cover of balata, Surlyn TM or other typical golf ball coverings. By eliminating the liquid filled core and elastic windings numerous manufacturing and quality control problems are eliminated; speed of manufacture is increased; and the resultant golf balls are more uniform, less expensive and can be made virtually indestructable when subjected to repetitive striking with golf clubs. Two-piece golf balls also tend to maintain a more perfect sphere over a much longer period of time than the conventional three-piece golf balls.

There has been a continual effort to describe new materials claiming to improve the two-piece golf ball in terms described above which are attributed to the three-piece golf ball, namely, compressibility and resiliency, rebound, club head feel, roll and flight characteristics because despite all the advances claimed, most golf professionals and skilled amateur golfers still prefer the conventional three-piece golf ball.

One objective of this invention is to provide a core of improved composition for a three-piece golf ball which will not leak or deteriorate over time; which exhibits excellent characteristics of resiliency, and which is easier to manufacture and maintain within quality standards as compared to conventional cores consisting of a vulcanized rubber sphere injection filled or otherwise filled with a suitable liquid.

Another object of this invention is to provide a winding of improved material for a three-piece golf ball which can be applied more uniformly during production; will not break during winding; and will result in a ball having greater resiliency, more uniform compressibility across its cross section and which maintains its perfect roundness on continued impact by a golf club. A golf ball manufactured with windings of this material will exhibit the compression, resiliency, rebound characteristics, "click" club-head feel, initial velocity, and flight and roll characteristics of a three-piece golf ball manufactured from materials currently in use or as described in the patent literature.

Moreover, the manufacturing process of the three-piece golf balls made from these materials will be less likely to generate a high number of rejects due to product being outside of established quality standards.

Another object of this invention is to provide a core of improved composition for a two-piece golf ball, which unlike current molded cores of two-piece golf balls, will exhibit the desireable characteristics of the standard three-piece golf ball described previously. Moreover, a two-piece golf ball made from this improved composition will maintain its perfect sphericity or roundness upon continued impact by a golf club, and lend itself to high speed manufacturing without generating an excessive amount of golf ball products which are out of standard.

The foregoing and other objects of the present invention are achieved in one aspect through the use of graphite fibers mixed with suitable resins; or graphite filaments which are then formed into fibers to which are applied suitable resins. The graphite fibers mixed with suitable resins is used in the core of the golf ball.

In another aspect of this invention, graphite filaments are grouped into tows of appropriate diameter and finished or impregnated with suitable thermosetting resins and substituted for the customary elastic windings in the golf ball.

The invention will be further explained with the aid of the accompanying drawing in which.

Figure 1:
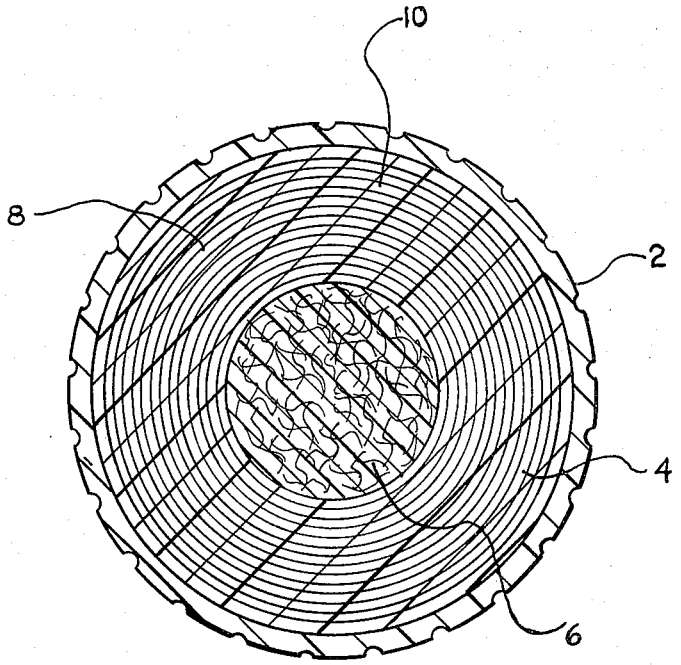
FIG. 1 is a cross sectional view of a three-piece golf ball.

In FIG. 1, a three-piece golf ball is shown having a cover 2, a winding 4, and a core 6.

In a preferred embodiment of the present invention, graphite fibers 8 and thermosetting epoxy and/or polyester resins 10 containing about 50–60% by weight of graphite fibers are intimately mixed, extruded and molded into an appropriately sized core 6 which is now suitable for accepting windings 4. This sphere or core 6 is hard, and has good resiliency, combined with a high degree of compressibility, so that the ball returns to a perfect sphere after impact by a golf club. A golf ball core 6 constructed from this material imparts excellent flight and roll characteristics to the final three-piece golf ball. The core 6 so constructed will maintain its resiliency and return to perfect spherical shape over time much longer than a conventional three-piece golf ball despite repeated impacts by a golf club.

Graphite fibers which are pre-impregnated by modified epoxy resins are commercially available and are sold under various trade names, such as those by Narmco, a division of the Celanese Co., New York, under the trade name, Rigidite 5209 or Rigidite 5213.

While highly satisfactory results are obtained from a mixture of graphite fibers 8 and thermosetting epoxy resins 10 which consists of 50–60% graphite fibers, higher or lower quantities of graphite may be used depending upon tension and winding procedures used to apply elastic windings 4 which are preferred in the manufacture.

Graphite core 6 so prepared will accept a suitable winding 4 of high tension elastic thread such as used in conventional three-piece construction and upon which a suitable cover 2 is applied in the customary manner.

In a further aspect of this invention, graphite filaments grouped into tows of appropriate diameter and finished or impregnated with suitable thermosetting resins, are employed in winding 4. Graphite fibers so applied exhibit a high modulus of elasticity after thermosetting, but will not be subject to breaking during application of the winding process. Graphite filaments such as Thormel 300 graphite yarn made by Union Carbide Corp., are each about 0.0003" in diameter and organized into yarns each of with may consist of 3,000 filaments; as many as 4 or more of these yarns may be combined into the final yarn which is finished with an epoxy resin sizing which is then used for the winding process.

Desirable properties of high tensile strength and a high modulus of elasticity can be built into the yarn to be used to form the windings around the graphite core. The resultant core plus winding will, when covered with a suitable material in the usual manner, produce a three-piece golf ball which meets U.S.G.A. specifications of diameter, weight, and initial velocity.

A three-piece golf ball made of a graphite core and graphite filament windings described in the embodiment above and to which a cover of suitable customary material has been applied will exhibit all of the desired characteristics displayed by three-piece golf balls preferred by most golf professionals and highly skilled amateurs.

Further, the three-piece golf ball constructed in this manner will lend itself to more simplified and less problematic manufacturing processes than encountered during the manufacture of a conventional three-piece golf ball. Fewer balls will be produced which are out of standard. A three-piece golf ball so constructed will maintain its perfect spherical shape under play longer than a conventional three-piece golf ball.

Figure 2:
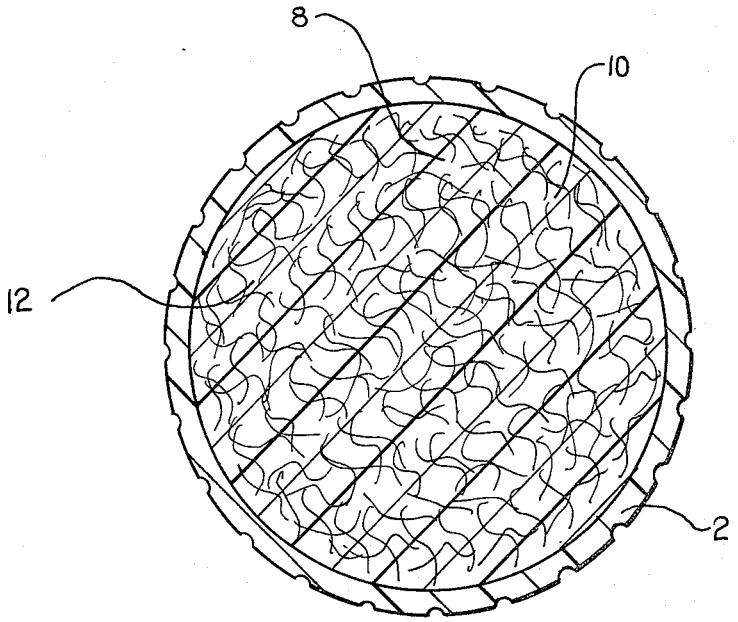
FIG. 2 is a cross sectional view of a two-piece golf ball.

FIG. 2 shows a two-piece golf ball constructed in accordance with the present invention and comprising a molded core 12 of graphite 8, and suitable resins 10 and other materials which lend themselves to thermosetting polymerization having a molded diameter of about 1.6 inches to which is applied a cover 2 of suitable material molded in a customary manner.

In one example, the materials comprising the core 12 will be graphite fibers 25–50% by weight, suitable polymerizable epoxy and/or polyester resins 25–50% by weight, for example an elastomer such as a 60% cis-polybutadiene, plus suitable amounts of curing or hardening compounds, fillers and cross linking catalysts.

The graphite fibers, resins and other materials are intimately mixed. The mixture may be extruded to a substantially correct diameter, and the appropriately sized extrudate is then molded or cured according to conventional practices utilized in manufacturing two-piece golf balls. After the molded core, which is about 1.60 inches in diameter, is set according to conventional methods, a suitable cover is applied in a customary manner.

The addition of graphite to the typical materials used in manufacture of the core of the two-piece golf ball imparts an unexpectedly high degree of compressibility combined with resiliency which when the ball is struck, quickly returns it to a perfect sphere to exhibit high initial velocity and excellent flight characteristics. Unlike two-piece golf balls made from various polymeric butadiene materials described in the literature and currently in use, this two-piece golf ball, because of the addition of graphite, exhibits characteristics remarkably close to those exhibited by conventional three-piece golf balls, mainly compressibility, resiliency, good rebound characteristics, excellent golf club feel, high initial velocity, and good flight and roll characteristics. Yet the two-piece golf ball so constructed will maintain its perfect sphericity after prolonged use and after continually being struck by a golf club. The two-piece golf ball so described maintains all of the manufacturing advantages described in the typical two-piece golf ball, namely relative simplicity, uniformity of product with a minimum of rejects, and speed of manufacture.

While the preferred embodiment uses graphite fibers together with polymeric 60% cis-butadiene plus other suitable materials which cause cross linking and thermosetting characteristics leading to polymerization, other materials can be used in conjunction with the graphite fibers. These include silanes or fiberglass fibers.

We claim:

1. A golf ball having a hard, yet resilient core within a cover, said core comprising graphite fibers uniformly dispersed throughout a resilient polymerized resin and a winding interposed between said core and cover, said winding being formed of graphite fiber yarns impregnated with a resilient polymerized resin.

2. The golf ball of claim 1 wherein said graphite fibers form 25 to 60% of the core by weight.

3. The golf ball of claim 2 wherein said graphite fibers form approximately 50–60% of the core by weight.

4. The golf ball of claim 1 wherein said resin is one of an epoxy or polyester elastomer.

5. The golf ball of claim 1 wherein said resin of said core comprises cis-polybutadiene and a curing agent.

6. The golf ball of claim 5 wherein said resin comprises 24–50% of the weight of said core.

7. The golf ball of claim 6 wherein said resin of said core includes a filler.

* * * * *